US010626678B2

(12) United States Patent
Yin et al.

(10) Patent No.: US 10,626,678 B2
(45) Date of Patent: Apr. 21, 2020

(54) REAMING DEVICE CONNECTING TO DOWNHOLE MOTOR WITH PARALLELED DRIVING STRUCTURE

(71) Applicant: Orient Energy & Technologies Co., Ltd., Langfang, Hebei (CN)

(72) Inventors: Yongqing Yin, Hebei (CN); Yongqi Yin, Hebei (CN); Lijiang Liu, Hebei (CN); Yinghui Yao, Hebei (CN); Xiyuan Wang, Hebei (CN); Qin Wang, Hebei (CN)

(73) Assignee: Orient Energy & Technologies Co., Ltd., Langfang, Hebei (CN)

( * ) Notice: Subject to any disclaimer, the term of this patent is extended or adjusted under 35 U.S.C. 154(b) by 206 days.

(21) Appl. No.: 15/870,607

(22) Filed: Jan. 12, 2018

(65) Prior Publication Data

US 2019/0218863 A1 Jul. 18, 2019

(51) Int. Cl.

| | |
|---|---|
| ***E21B 10/26*** | (2006.01) |
| ***E21B 4/02*** | (2006.01) |
| ***E21B 41/00*** | (2006.01) |

(52) U.S. Cl.

CPC ..... *E21B 10/26* (2013.01); *E21B 4/02* (2013.01); *E21B 41/0078* (2013.01)

(58) Field of Classification Search

CPC ..... E21B 10/26; E21B 4/02; E21B 41/0078

See application file for complete search history.

(56) References Cited

U.S. PATENT DOCUMENTS

2018/0274297 A1* 9/2018 Pearson ..... E21B 4/02

* cited by examiner

*Primary Examiner* — Kristyn A Hall

(74) *Attorney, Agent, or Firm* — Novick, Kim & Lee, PLLC; Allen Xue

(57) ABSTRACT

A reaming device connects to downhole motor with paralleled driving structure. The downhole motor contains power section assembly, sleeve and connection pad. The power section assembly has a rotor and a stator in which the stator covers the rotor. The sleeve is located inside the rotor that drives the sleeve to make rotation. The connection pad is affixed to and rotates with the sleeve is disposed on the one end of the extended part of rotor from the bottom of sleeve. The reamer is set on the stator of power section assembly or on the cover connecting to the stator from power section assembly. The rotor drives the reamer to rotate with the stator or on the cover connecting to the stator through the sleeve and the connection pad.

8 Claims, 4 Drawing Sheets

REAMING DEVICE CONNECTING TO DOWNHOLE MOTOR WITH PARALLELED DRIVING STRUCTURE

TECHNICAL FIELD

This disclosure pertains to a reaming device, which belongs to non-excavation technical field.

BACKGROUND

As for the present non-excavation field, the common reaming method is to apply drilling machine to drive the drilling rod and reamer when reaming hole with a diameter of 100 mm or larger. Due to frictions caused by the drilling rod and hole when rotating, the most part of the driving force provided by the drilling machine is consumed by the rotation of drilling rod whilst only small part of force is used for reaming via reamer. Thus the reaming method mentioned herein is not efficient. In order to solve the problem of consumption of driving force by rotation of drilling rod, a type of reaming tool appears from present technology, which utilizes hydraulic pump to drive power section assembly so as to force the rotation of reamer for the realization of reaming. The reaming tool contains power section assembly, driving shaft and reamer, and the rotor from power section assembly connects to reamer via driving shaft. The drilling liquid with high pressure from hydraulic pump via liquid inlet of power section assembly comes into screw cavity formed between stator and rotor and then comes out from liquid outlet of power section assembly with low pressure. Through the pressure difference, the drilling liquid drives rotor to rotate and then the rotor forces reamer to rotate via driving shaft for the realization of reaming. As for the reaming tool, only reamer rotates and the energy (or called work) is mostly used for reaming, which solves the problem that the consumption of driving force during the rotation of drilling rod when drilling machines drives reamer for reaming. However, due to the flexible connection of driving shaft to power section assembly and reamer and because of the incompact structure caused by the certain length of driving shaft, the driving shaft is not capable of bearing large torque, which frequently leads to the fracture of driving shaft while reaming. Hence, the drilling tool is not capable of providing a large torque to ream holes with large diameter because of the unsatisfactory strength of the tool.

SUMMARY

Aiming to solve the technical problems stated above for present technology, this disclosure applies a type of reaming device connecting to downhole motor with paralleled driving structure, which is characteristic of high rigidity and strength and which is capable to provide larger torques for reaming holes with larger diameter.

In order to solve the mentioned technical problems, the technical solution applied in this disclosure is as follows:

A type of downhole motor with paralleled driving structure contains power section assembly, sleeve and connection pad. The power section assembly comprises of rotor and stator in which the stator covers the rotor. The sleeve is located inside the rotor and the top of sleeve is fixed with the liquid inlet located in the inner rotor. Meanwhile, the rotor is able to drive the sleeve to rotate and the connection pad which is on the one end of the extended part of rotor at the bottom end of sleeve is fixed and rotates with the sleeve. Preferably, inner screw thread is in the liquid inlet of rotor.

A locked nut with outer screw thread screws with the inner screw thread to the surface of sleeve. The rotor drives sleeve to rotate via locked nut. The outer periphery at the bottom of sleeve forms the first hexagonal surface. The first hexagonal hole is set in the center of connection pad that rotates with the sleeve via the coordination of the first hexagonal hole and the first hexagonal surface.

A type of reaming device connecting to mentioned downhole motor with paralleled driving structure, containing downhole motor and reamer. The reamer is set on the stator of power section assembly or on the cover connecting to the stator from power section assembly. The rotor drives the reamer to rotate on the stator or on the cover connecting to the stator through the sleeve and the connection pad.

Preferably, the sleeve stabilizer is set on the surface of stator of downhole motor. Alternatively, the dovetail groove is set in the inner wall of sleeve stabilizer and the outer surrounding of stator forms the dovetail block which matches to the dovetail groove. The sleeve stabilizer is set on the stator through the coordination of dovetail block and dovetail groove.

Preferably, the mounting sleeve of reamer is applied between the reamer and the stator. The mounting sleeve of reamer is fixed with the reamer and is able to rotate along with reamer relatively with stator. The mounting sleeve of reamer drives reamer to rotate under the driving of connection pad. Alternatively, the second liquid outlet hole is made on the mounting sleeve of reamer to connect with the liquid outlet of power section assembly.

Further preferably, the first saw teeth is fitted to a circle outside connection pad and the second saw teeth is fitted to a circle on the surface corresponding to mounting sleeve of reamer and connection pad. The connection pad drives the mounting sleeve of reamer to rotate through the coordination of the first and second saw teeth; the second liquid outlet hole is made on the mounting sleeve of reamer to connect with the liquid outlet of power section assembly.

Preferably, the spindle and spray head is also contained. The spray head contains cross over sub and nozzle. As for the downhole motor and spindle stated herein, there are two ends. The end of liquid inlet from the power section assembly is named the first end and the end of liquid outlet is named the second end. The spindle is located inside the sleeve of downhole motor. The first end extends the sleeve and the spindle is fixed with the stator. The first end of the spindle forms the liquid incoming channel connecting with the liquid inlet of the power section assembly. The top end of the cross over sub is at the second end of the spindle and is fixed with the spindle; the nozzle is at the bottom end of the cross over sub and is fixed with the cross over sub. The first liquid outlet channel is formed between spray head and the liquid outlet of power section assembly.

Further preferably, the outer sleeve where a hole is made in the center is set at the send connection pad from the downhole motor. The outer sleeve connecting to the cross over sub is fixed with the connection pad and is able to rotate along with sleeve relatively with cross over sub. The first liquid outlet channel sequentially extends through connection pad, outer sleeve and cross over sub. Preferably, one end of outer sleeve facing the connection pad forms the step hole and the connection pad forms the corresponding step surface. The outer sleeve is affixed on the connection pad through the coordination of step hole and step surface.

In a further preferred embodiment, the second hexagonal hole is set at the surface of the first end of stator. The second hexagonal surface is formed on the outer surrounding of the corresponding position of spindle and the second hexagonal hole. A hexagonal nut is set at the spindle, the inner hole and outer surrounding is matched with the second hexagonal surface and the second hexagonal hole correspondently. The spindle restricts the rotation of stator through the separate coordination of the hexagonal nut with the second hexagonal surface and the second hexagonal hole.

In another further preferred embodiment, the jet joint is set at the bottom end of the cross over sub and is fixed with the cross over sub. The first diversion hole, inside which a cavity is established near cross over sub, is set in the center of jet joint. At the connection surface of the cavity and jet joint, the second diversion hole is set, which slants toward the reamer. The nozzle extends into the cavity. Alternatively, the cone screw thread hole is set on the top surface of jet joint and the cone screw thread is set in the outer surrounding at the bottom end of cross over sub. The cone screw thread in cross over sub matches and connects to the screw thread in cone screw thread hole of jet joint.

Preferably, the mounting sleeve of reamer is set on the stator via bearing sleeve. One load nut is disposed outside bearing at each end of the mounting sleeve of reamer. The floating seats are set separately on the outer surface of the two load nut mentioned above. The floating seat and load nut surrounds a string of ring cavity in which a single-slice metallic floating sealing part is set.

Compared with present technology, the beneficial effect of the reaming device in this disclosure is as follows:

1. In this disclosure, the reamer of the reaming device is installed on the stator of power section assembly, which makes the structure of reaming device so compact that the reaming device is capable of high rigidity and strength during rotation to provide more energy (i.e. torsion torque) for the reamer. Compared with the reaming tool containing power section assembly and reamer connected through driving shaft at present technology, the reaming device in this disclosure is capable of reaming holes with larger diameter.

2. Because the reaming device in this disclosure utilizes power section assembly to provide energy for reamer, only reamer rotates rather than the stator from power section assembly when reaming, the work consumed by reaming device is almost used for reaming. Thus, compared with the reaming activity that drilling machine drives drilling rod at present technology, higher utilization rate of effective work and less power loss is achieved by using the reaming device in this disclosure that applies power section assembly as force to make reaming activity.

In those figures: 1—stator, 2—rotor, 3—mounting sleeve of reamer, 4—sleeve, 5—spindle, 6—connection pad, 7—outer sleeve, 8—cross over sub, 9—nozzle, 10—hexagonal nut, 11—second locked nut, 12—first locked nut, 13—sleeve stabilizer, 14—bearing, 15—first liquid outlet channel, 16—liquid incoming channel, 17—radial bearing, 18—jet joint, 19—load nut, 20—floating seat, 21—single-slice pure metallic floating sealing, 22—block ring, 30—spray head, 61—first saw teeth, 181—first diversion hole, 182—second diversion hole, 183—cavity, 301—second liquid outlet hole, 302—second saw teeth, 100—reamer.

EMBODIMENTS

In order to help technicians in this field comprehend the technical solution to this disclosure, specific description for this disclosure is illustrated as follows through the combination of figures and specific embodiments.

Figure 1:
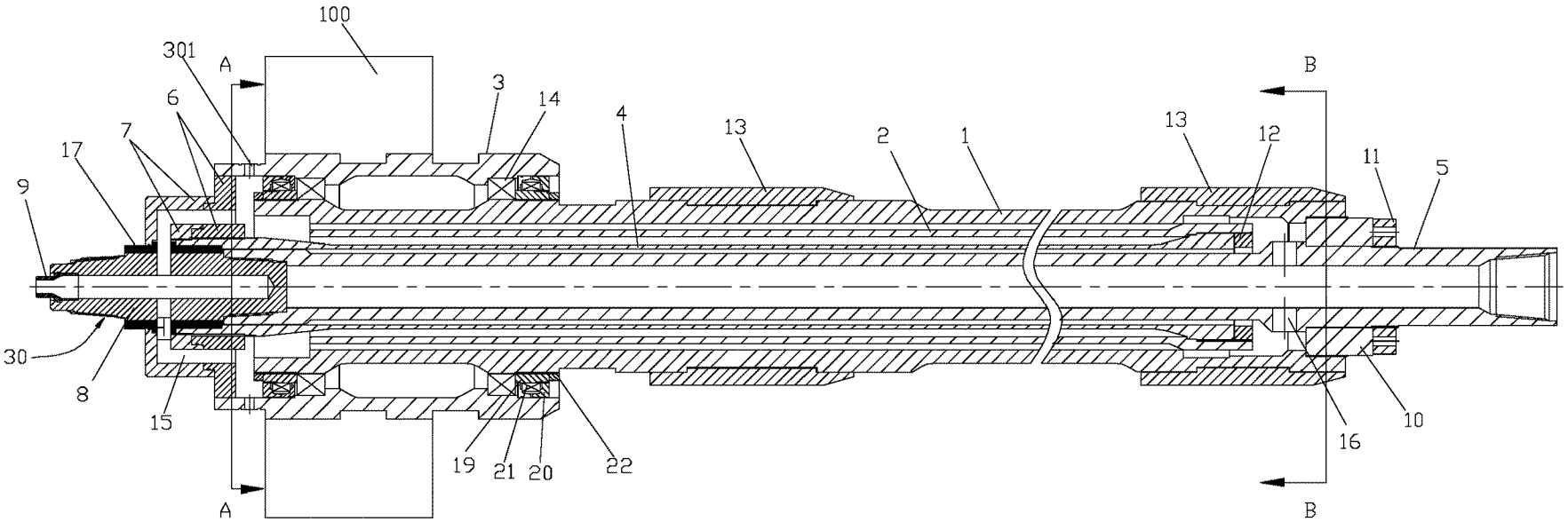
FIG. 1 is a Sectional View of the Reaming Device.

As shown in FIG. 1, the embodiment in this disclosure discloses a type of power reaming device which contains power section assembly, reamer 100 and spray head 30. The power section assembly contains rotor 2 and stator 1 that covers rotor 2. The rotatable reamer 100 is set on stator 1 and rotor 2 drives reamer 100 rotate on stator 1 for the realization of reaming.

It should be understood that how the rotation of rotor 2 in the power section assembly is realized belongs to present technology. The operation of power section assembly is described below. The screw cavity is formed between rotor 2 and stator 1 in power section assembly. The drilling liquid with high pressure from hydraulic pump via liquid inlet of power section assembly (i.e. one end of screw cavity) comes into screw cavity and then comes out from liquid outlet of power section assembly (i.e. another end of screw cavity) with low pressure. Through the pressure difference between the liquid inlet and outlet of power section assembly, the drilling liquid drives rotor 2 to rotate relatively with stator 1 on the basis of certain torque.

From above mentioned information, the reamer 100 of the power reaming device in this disclosure is installed on stator 1 of power section assembly so as to compact the structure of power reaming device. Thus the power reaming device is capable of high rigidity and strength in the aspect of rotation and then is able to provide more driving force (i.e. torque) for reamer 100. Compared with the reaming tool containing power section assembly and reamer 100 connected through driving shaft at present technology, the power reaming device in the disclosure is able to ream hole with larger diameter. In addition, because the reaming device in this disclosure utilizes power section assembly to provide energy for reamer 100, only reamer 100 rotates when reaming, the work consumed by reaming device is almost used for reaming. Thus, compared with the reaming activity that drilling machine drives drilling rod at present technology, higher utilization rate of effective work and less power loss is achieved by using the reaming device in this disclosure that applies power section assembly as force to make reaming activity.

The reamer 100 of power reaming device is able to drive directly via rotor 2 and also to drive indirectly via intermediate driving parts. As shown in FIG. 1, according to a preferred embodiment in this disclosure, rotor 2 transmits torque to reamer 100 via sleeve 4 and connection pad 6. Specifically, rotor 2 is set on sleeve 4 and drives sleeve 4 to rotate. One end of sleeve 4 extends rotor 2 where connection pad 6 is set and rotates with sleeve 4, and sleeve 4 drives reamer 100 to rotate via connection pad 6. Thus rotor 2 is able to drive reamer 100 to rotate via sleeve 4 and connection pad 6.

The reamer 100 of power reaming device is able to set on stator 1 in various ways. For example, reamer 100 can be directly set on stator 1 via bearing. As shown in FIG. 1, according to a preferred embodiment in this disclosure, reamer 100 is set on stator 1 via mounting sleeve 3 of reamer. Specifically, one pair of bearing 14 is mounted between mounting sleeve 3 of reamer and stator 1, and one pair of load nuts 19 are set on both sides of the pair of bearing 14. Every load nut 19 is fitted with floating seat 20 so that the floating seat 20 and load nut 19 circulates one ring cavity in which single-slice pure metallic sealing structure 21 to prevent impurities from coming into mounting sleeve 3 of reamer and avoid lubricant oil to leak from inside. Meanwhile, the block ring 22 is mounted at each side of the pair of load nuts 19 for restricting mounting sleeve 3 of reamer to move upward from the spindle of stator 1. Reamer 100 is set on mounting sleeve 3 of reamer and realizes the fixation with mounting sleeve 3 of reamer through key connection. Thus, mounting sleeve 3 of reamer drives reamer 100 to rotate under the driving of connection pad 6.

As shown in FIG. 1, according to another embodiment in this disclosure, the power reaming device also contains spindle 5, and spray head 30 contains cross over sub and nozzle 9. For convenient description, the end of liquid inlet of power section assembly where stator 1, rotor 2, sleeve 4 and spindle 5 are located is named the first end while the end of liquid outlet is named the second end. Sleeve 4 is set on spindle 5, the second end of which extends out of the second end of sleeve 4. Stator 1 restricts the rotation of spindle 5, the first end of which forms liquid incoming channel 16 penetrating liquid inlet of power section assembly. One end of cross over sub 8 extends into the second end of spindle 5 to connect with cone screw thread of spindle 5. The second end of cross over sub 8 is mounted with nozzle 9. The first liquid outlet channel 15 is formed between nozzle 9 and liquid outlet of power section assembly. Thus, the drilling liquid from hydraulic pump comes into liquid inlet of power section assembly along liquid incoming channel via the first end of spindle 5, comes out from liquid outlet of power section assembly, and then spray out from nozzle 9 via the first liquid outlet channel 15.

It should be understood that the connection pad 6 of power reaming device as the driving part for reamer 100 should rotate along with sleeve 4 on the one hand, and should be able to drive mounting sleeve 3 of reamer to rotate on stator 1 on the other.

Figure 4:
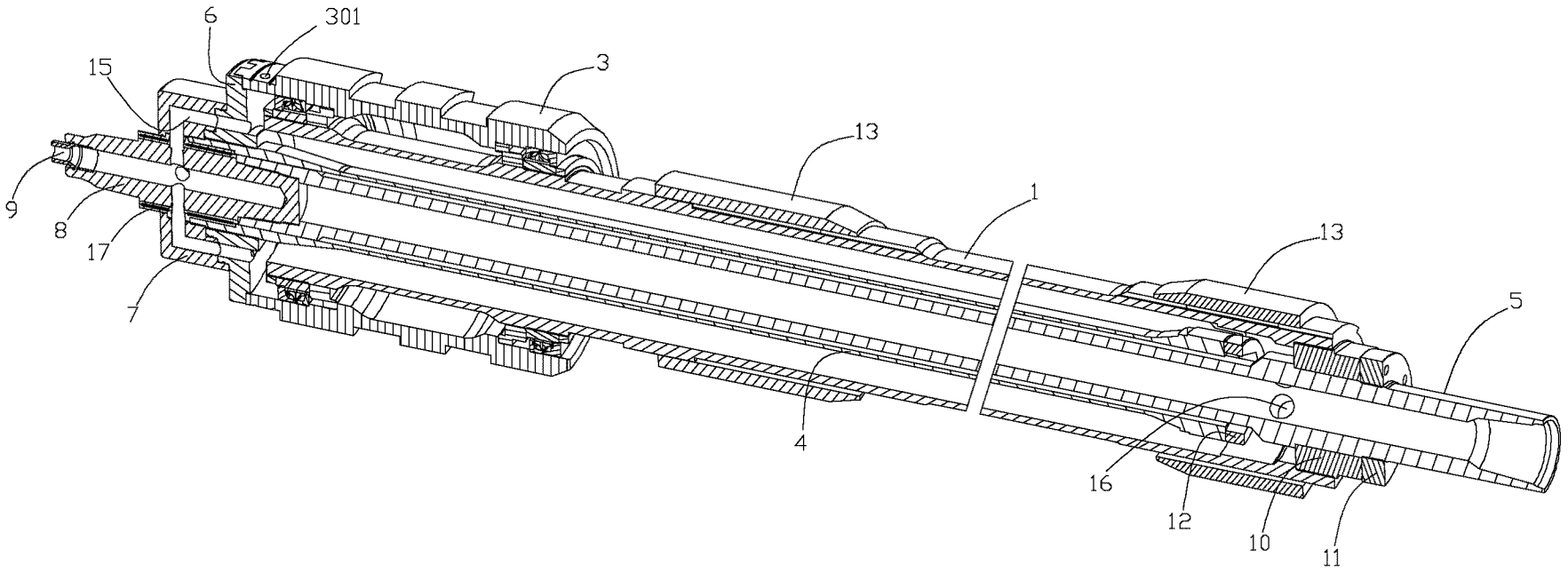
FIG. 4 is a Stereoscopic View of the Reaming Device.
Figure 5:
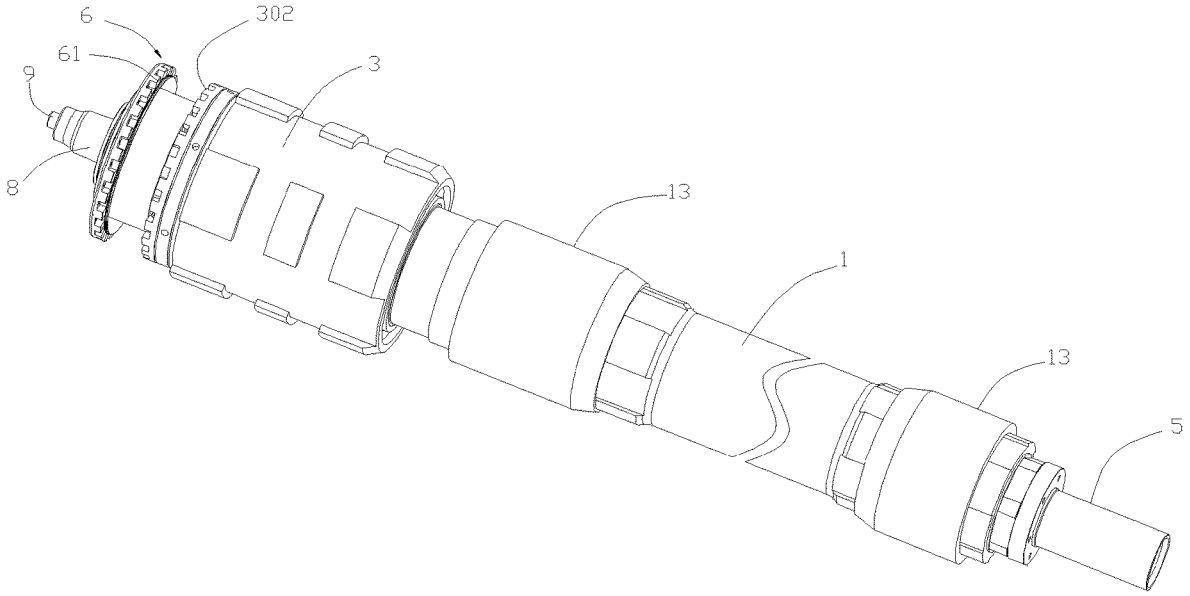
FIG. 5 is a Partial Decomposition View of Reaming Device.

Connection pad 6 is able to drive mounting sleeve 3 of reamer to rotate on stator 1 in several different ways such as the key connection between connection pad 6 and mounting sleeve 3 of reamer. As shown in FIG. 5 and with the combination of FIGS. 1 and 4, according to a preferred embodiment in this disclosure, the mounting sleeve 3 of reamer is set at the second end of stator 1 and the connection pad 6 is set at the second end of sleeve 4. The outer surrounding of connection pad 6 sets a circle of the first saw teeth 61 and the corresponding surface between mounting sleeve 3 of reamer and connection pad 6 sets a circle of the second saw teeth 302. The connection pad 6 drives reamer 100 to rotate via the coordination of the first saw teeth 61 and the second saw teeth 302.

It should be explained that in order to realize the connection between connection pad 6 and mounting sleeve 3 of reamer, in addition that the teeth amount and appearance of the first saw teeth 61 and the second saw teeth 302 should be the same, connection pad 6 and mounting sleeve 3 of reamer should also form positional relation of mutual plug-in for the first saw teeth 61 and the second saw teeth 302. The mentioned position relation can be guaranteed at design stage via simple dimension design and calculation to relevant assembly parts. Hence, technicians in this field are able to conceive and achieve.

The function of connection pad 6 is to transmit torque from the rotation of rotor 2 toward reamer 100. On the one hand, because the axial dimension of connection pad 6 is far less than the radial dimension, high rigidity and strength perform in the aspect of torque transmission, which means that connection pad 6 is capable of bearing huge torque without distortion and fracture. On the other hand, the connection method between connection pad 6 and mounting sleeve 3 of reamer is through tooth joint, which is capable to bear huge torque. Hence, connection pad 6 is capable of transmitting larger torque provided by rotor 2 to reamer 100 so that reamer 100 is able to ream larger holes.

Figure 2:
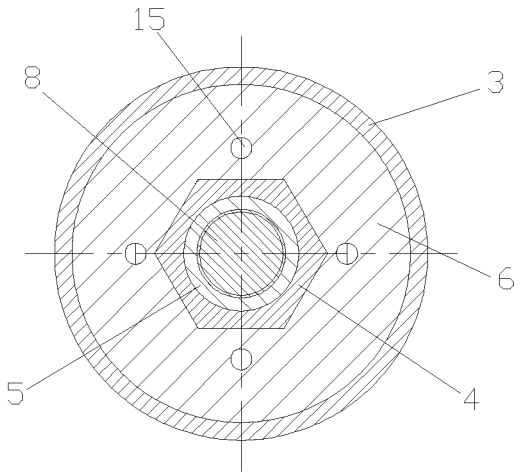
FIG. 2 is a Sectional View taken along line A-A of FIG. 1.
Figure 3:
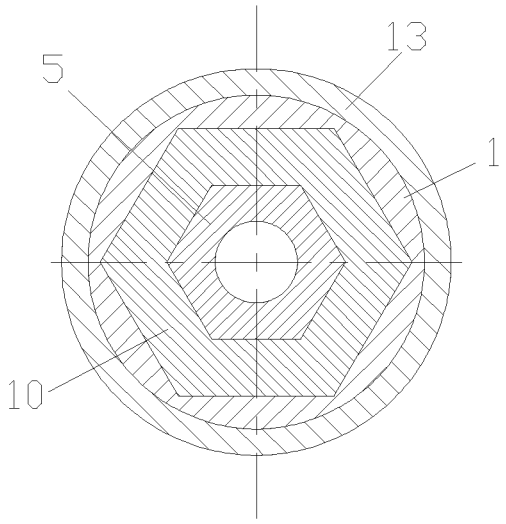
FIG. 3 is a Sectional View taken along line B-B of FIG. 1.

From above mentioned information, the motion and driving relation among stator 1, rotor 2, sleeve 4 and connection pad 6 of power reaming device in this disclosure are as follows: Stator 1 restricts the rotation of spindle 5; Rotor 2 drives sleeve 4 to rotate; Sleeve 4 drives connection pad 6 to rotate. The motion and driving for the parts mentioned above can be realized in various ways. For example, the method of welding fixation can be realized on the following combination: stator 1 and spindle 5, rotor 2 and sleeve 4, sleeve 4 and connection pad 6. According to a preferred embodiment in this disclosure, as shown in FIG. 4 and with the combination of FIG. 1, the inner screw thread is set in the first end of rotor 2. The first locked nut 12 having outer screw thread screws with the inner screw thread to tighten sleeve 4. Thus, rotor 2 and sleeve 4 are fixed at the first end through the first locked nut 12 so that rotor 2 is able to drive sleeve 4 to rotate. As FIG. 2 shown with the combination of FIG. 1 and FIG. 4, the outer periphery of the second end of sleeve 4 forms the first hexagonal surface and the center of connection pad 6 sets the first hexagonal hole. Connection 6 and sleeve 4 are fixed through the coordination of the first hexagonal hole and the first hexagonal surface. Thus, sleeve 4 is able to drive connection pad 6 to rotate. As shown in FIG. 3 and with the combination of FIG. 1 and FIG. 4, the surface of the first end of stator 1 sets the second hexagonal hole, and the outer periphery at the corresponding position between spindle 5 and the second hexagonal hole forms the second hexagonal surface. Hexagonal nut 10 sets on spindle 5, the inner hole and outer periphery of which separately matches with the second hexagonal surface and the second hexagonal hole. Stator 1 is connected with spindle 5 through the coordination of hexagonal nut 10 with the second hexagonal surface and the second hexagonal hole separately. Meanwhile, stator 1 and spindle 5 are locked tightly through the second locked nut 11. Thus, the tight connection can be realized at the first end for stator 1 and spindle 5 so that spindle 5 is able to restrict the rotation of stator 1.

The first liquid outlet channel can be formed through penetrating one part or various parts of power reaming device. As shown in FIG. 1 and with the combination of FIG. 4, for another embodiment in this disclosure, the power reaming device also contains outer sleeve 7, which is set rotatably on cross over sub 8 through radial bearing 17. Outer sleeve 7 forms step hole at the end toward connection pad 6 and connection pad 6 forms the corresponding step surface so that outer sleeve 7 buckles on connection pad 6 through the coordination of step hole and step surface. The first liquid outlet channel 15 penetrates through connection pad 6, outer sleeve 7 and cross over sub 8 in sequence.

Figure 6:
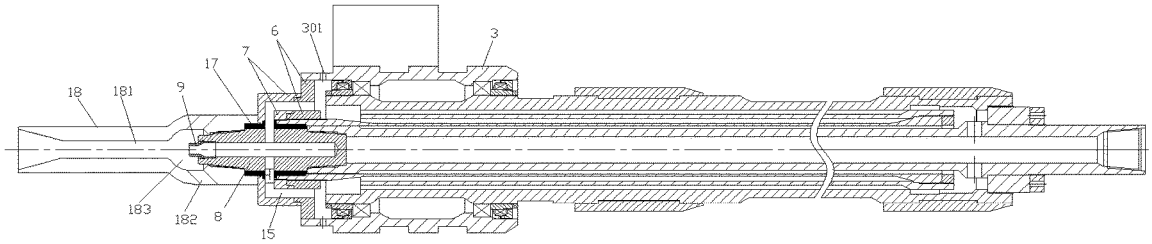
FIG. 6 is a Sectional View of the Reaming Device With Jet Joint Mounted.

Reamer 100 will cause large heat during reaming, which will increase the abrasion of reamer 100, decrease the reaming efficiency and reduce the service life of reamer 100 if the heat cannot be diffused or brought out in time. In addition, the silt caused by reaming increases the abrasion of reamer 100. In order to bring out the heat and silt during reaming, According to a preferred embodiment in this disclosure, as shown in FIG. 6, the second of cross over sub 8 sets the jet joint 18, the surface of the first end of which sets cone screw thread hole. The bottom end of cone screw thread sets the cavity 183. The surface of the second end of jet joint 18 sets the first diversion hole 181 connecting to cavity 183. The peripheral surface of jet joint 18 sets the second diversion hole 182 which slants toward reamer 100 connecting to cavity 183. The outer periphery of the second end of cross over sub 8 sets cone screw thread. The second end of cross over sub 8 connects to the screw thread of the first end of jet joint 18, and nozzle 9 extends into cavity 183. Mounting sleeve 3 of reamer sets the second liquid outlet hole 301 connecting to the liquid outlet of power section assembly. Thus, the drilling liquid from liquid outlet of power section assembly can be divided into two parts: The first part comes into jet joint 18 from nozzle 9 through the first liquid outlet channel 15 and forms jet at nozzle 9 while the second part sprays reamer 100 through the second liquid outlet hole 301 so as to bring out the heat and silt. Because the jet exists at nozzle 9, the drilling liquid from the second part carrying heat and silt collects in cavity 183 of jet joint 18 at nozzle 9 through the second diversion hole, and sprays out through the first diversion hole along with the drilling liquid from the first part.

As shown in FIGS. 1, 4 and 5, according to another preferred embodiment in this disclosure, the outer periphery of stator 1 sets sleeve stabilizer 13, the inner wall of which sets dovetail groove. The outer periphery of stator 1 forms the dovetail block corresponding to the dovetail groove. Sleeve stabilizer 13 sets on stator 1 through the coordination of dovetail block and dovetail groove.

It is known from above that the power reaming device in this embodiment drives rotor 2 to rotate via hydraulic pump. Because fixed with sleeve 4 at the first end, rotor 2 drives sleeve 4 to rotate, and then sleeve 4 drives reamer 100 to rotate through connection pad 6 so as to realize the reaming activity. Meanwhile, the drilling liquid comes into liquid inlet of power section assembly and comes out from liquid outlet. The drilling liquid of the first part comes into jet joint 18 through the first liquid outlet channel and that of the second part sprays to reamer 100 through the second liquid outlet hole to bring out heat and silt. The drilling liquid carrying heat and silt comes into jet joint 18 through the second diversion hole 182 and interflows with the drilling liquid of the first part, then sprays out through the first diversion hole 181. The power reaming device in this embodiment is able not only to ream holes with larger diameter but to bring out heat and silt caused by reaming via drilling liquid so as to reduce the abrasion of reamer 100 and to improve the service life of reamer 100.

The embodiment above mentioned is only illustrative which is not to restrict this disclosure. The protection range of this disclosure is restricted by claims. The technicians in this field are authorized to make modification or equivalent replacement under the essence and protection range whilst those modification or equivalent replacement is also regarded inside the protection range of this disclosure.

The invention claimed is:

1. A downhole motor, comprising: a rotor, a stator that sleeves over the rotor, a sleeve affixed to the rotor, a spindle affixed to the stator, and a connection pad, wherein the rotor sleeves over the sleeve and the sleeve sleeves over a portion of the spindle, wherein a liquid inlet is disposed at a first end of the sleeve and the connection pad is affixed to a second end of the sleeve, and wherein the rotor, the sleeve, and the connection pad are configured to rotate together.

2. A reaming device, comprising a downhole motor of claim 1, a reamer mounting sleeve that sleeves over a portion of the stator of the downhole motor, and a reamer affixed to the reamer mounting sleeve, wherein the reamer mounting sleeve is affixed to the connection pad so that the reamer mounting sleeve is configured to rotate with the rotor.

3. The reaming device of claim 2, further comprising a spray head connected to the spindle, wherein the spray head comprises a cross over sub and a nozzle.

4. The reaming device of claim 3, further comprising a jet joint connected to the spray head, wherein the jet joint has a liquid channel comprising a cavity and a diversion hole, wherein the nozzle of the spray head extends into the cavity.

5. The reaming device of claim 2, wherein the connection pad has a first saw-tooth shaped periphery and the reamer mounting sleeve has a second saw-tooth shaped periphery, wherein the connection pad and the reamer mounting sleeve are affixed together by engaging the first saw-toothed periphery with the second saw-toothed periphery.

6. The reaming device of claim 5, wherein the reamer mounting sleeve is a bearing sleeve.

7. The reaming device of claim 2, further comprising a sleeve stabilizer disposed on a surface of stator.

8. The reaming device of claim 2, wherein the reamer mounting sleeve is a bearing sleeve.

* * * * *